US009196948B2

(12) United States Patent
Yamamoto et al.

(10) Patent No.: US 9,196,948 B2
(45) Date of Patent: Nov. 24, 2015

(54) ANTENNA SYSTEM FOR WIRELESS TERMINAL DEVICES

(71) Applicant: LENOVO (SINGAPORE) PTE. LTD., Singapore (SG)

(72) Inventors: Osamu Yamamoto, Kanagawa-ken (JP); Takaai Okada, Kanagawa-ken (JP)

(73) Assignee: LENOVO (SINGAPORE) PTE LTD, Singapore (SG)

( * ) Notice: Subject to any disclaimer, the term of this patent is extended or adjusted under 35 U.S.C. 154(b) by 205 days.

(21) Appl. No.: 13/749,172

(22) Filed: Jan. 24, 2013

(65) Prior Publication Data

US 2013/0207853 A1 Aug. 15, 2013

(30) Foreign Application Priority Data

Feb. 11, 2012 (JP) ..... 2012-027868

(51) Int. Cl.

| | |
|---|---|
| ***H01Q 1/24*** | (2006.01) |
| ***H01Q 1/00*** | (2006.01) |
| ***H01Q 1/22*** | (2006.01) |
| ***H01Q 1/50*** | (2006.01) |
| ***H01Q 1/52*** | (2006.01) |
| ***H01Q 9/42*** | (2006.01) |

(52) U.S. Cl.

CPC ..... *H01Q 1/002* (2013.01); *H01Q 1/2266* (2013.01); *H01Q 1/241* (2013.01); *H01Q 1/50* (2013.01); *H01Q 1/526* (2013.01); *H01Q 9/42* (2013.01)

(58) Field of Classification Search

USPC ..... 343/700 MS, 702, 833, 841

See application file for complete search history.

(56) References Cited

U.S. PATENT DOCUMENTS

| | | | | |
|---|---|---|---|---|
| 5,914,696 | A | 6/1999 | Vanderhelm et al. | |
| 7,589,680 | B2 * | 9/2009 | Tsai et al. | 343/702 |
| 7,602,341 | B2 * | 10/2009 | Wei-Shan et al. | 343/700 MS |
| 8,836,588 | B2 * | 9/2014 | Hayashi et al. | 343/702 |
| 2003/0148784 | A1 | 8/2003 | Sawamura et al. | |
| 2009/0086420 | A1 * | 4/2009 | Stockham et al. | 361/679.26 |

FOREIGN PATENT DOCUMENTS

| | | |
|---|---|---|
| CN | 1507674 A | 6/2004 |
| CN | 1925213 A | 3/2007 |

(Continued)

OTHER PUBLICATIONS

Yoshitsugu, "Consideration for protection from Non-ionizing radiation", Kamiyama, Japan Health Physics society, vol. 32, No. 2. 1997.

*Primary Examiner* — Tan Ho

(74) *Attorney, Agent, or Firm* — Antony P. Ng; Russell Ng PLLC

(57) ABSTRACT

An antenna system suitable for a mobile device is disclosed. The mobile device includes a display casing with a conductive region and a non-conductive region. The antenna system includes a driven element having an inverted-F antenna arranged in the non-conductive region of the display casing. The display casing is also provided with an electrostatic discharge (ESD) conductor as a countermeasure against ESD. The ESD conductor is connected to the conductive region of the casing. The ESD conductor causes static charges in the air to be discharged to the conductive region of the casing. The ESD conductor also produces harmonic resonance and exchanges electromagnetic energy with the driven element to improve the gain of the driven element.

9 Claims, 4 Drawing Sheets

(56) References Cited

FOREIGN PATENT DOCUMENTS

| | | | |
|---|---|---|---|
| CN | 101330162 | A | 12/2008 |
| CN | 102156564 | A | 8/2011 |
| JP | 2004-064282 | | 2/2004 |
| JP | 2006-40202 | | 2/2006 |
| JP | 2006-42111 | | 2/2006 |
| JP | 2006042111 | A | 2/2006 |
| JP | 2007-174540 | | 7/2007 |
| JP | 2007-201908 | | 8/2007 |
| JP | 2009-004875 | | 1/2009 |
| JP | 2011-165206 | | 8/2011 |
| WO | 2008-123148 | A1 | 10/2008 |
| WO | 2011-162216 | A1 | 12/2011 |

* cited by examiner

ANTENNA SYSTEM FOR WIRELESS TERMINAL DEVICES

PRIORITY CLAIM

The present application claims benefit of priority under 35 U.S.C. §§120, 365 to the previously filed Japanese Patent Application No. JP2012-027868 with a priority date of Feb. 11, 2012, which is incorporated by reference herein.

BACKGROUND OF THE INVENTION

1. Technical Field

The present invention relates to antenna systems in general, and in particular to an antenna system adapted to a relatively low frequency band of wireless wide-area network.

2. Description of Related Art

A laptop personal computer (laptop PC) includes many antennas mounted thereon for handling different wireless communications systems such as WiMAX, wireless local-area network (wireless LAN), and wireless wide-area network (wireless WAN). A laptop PC performs data communication through the wireless WAN established by using a mobile phone communications network. In North America, primarily, the third generation (3G) personal communications service (PCS) band and the cellular band are available as the mobile phone frequency bands. The PCS uses the 1,900 MHz band. The cellular band has been the 850 MHz band. In Europe, primarily, the GSM 900/1,800 MHz band and the UMTS 2,100 MHz band have been used as the mobile phone frequency bands.

Further, in the 700 MHz band, a fourth generation (4G) mobile communications service based on the communications standard called Long-Term Evolution (LTE) has been started. In the United States, Verizon Wireless Inc. offers the LTE service using the 750 MHz band (from 747 MHz to 787 MHz), and AT&T Inc. offers the LTE service using the 700 MHz band (from 704 MHz to 746 MHz). Further, in Europe, Vodafone Inc. is planning to offer the LTE service using the 790 MHz band (from 790 MHz to 862 MHz).

An antenna increases in length and size as the resonance frequency decreases. Further, the antenna gain decreases when a sufficient element length cannot be secured for the resonance frequency. In the case of adopting the LTE using the 700 MHz band, the required element length further increases. In a laptop PC, an antenna is disposed inside the rim of the display casing so as to obtain good radio properties during the use. Inside the rim of the display casing, a camera, a microphone, and an LED for illuminating the keyboard surface are disposed in addition to the antenna. Thus, a problem has arisen that, with the space conventionally available for the wireless WAN antenna, it would be difficult to guarantee sufficient gain for the frequencies near 700 MHz.

Meanwhile, a circuit board on which a camera and a microphone are mounted may be destroyed by a surge current that flows in from the outside through an opening of the display casing due to electrostatic discharge (ESD). Therefore, a countermeasure against ESD has been taken for the circuit board. Specifically, the ESD countermeasure for the circuit board is implemented by covering the part of the circuit board that is vulnerable to ESD, with a conductive sheet serving as an arrester.

The conductive sheet is connected to a ground plane of a motherboard via a shield of a signal line connected to the circuit board. A conductor that is maintained at the ground potential existent in the vicinity of the antenna may adversely affect the radio properties of the antenna.

Consequently, it would be desirable to provide an antenna system that can be disposed in a narrow space in a wireless terminal device such that the antenna can be placed as far apart as possible from the shielded line or conductive material connected to the conductive sheet.

SUMMARY OF THE INVENTION

In accordance with a preferred embodiment of the present invention, a mobile device includes an antenna system capable of providing an improved gain at around 700 Mhz. The mobile device includes a display casing with a conductive region and a non-conductive region. The antenna system includes a driven element having an inverted-F antenna arranged in the non-conductive region of the display casing. The display casing is also provided with an electrostatic discharge (ESD) conductor as a countermeasure against ESD. The ESD conductor is connected to the conductive region of the casing. The ESD conductor causes static charges in the air to be discharged to the conductive region of the casing. The ESD conductor also produces harmonic resonance and exchanges electromagnetic energy with the driven element to improve the gain of the driven element.

All features and advantages of the present disclosure will become apparent in the following detailed written description.

BRIEF DESCRIPTION OF THE DRAWINGS

The disclosure itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

Figure 1:
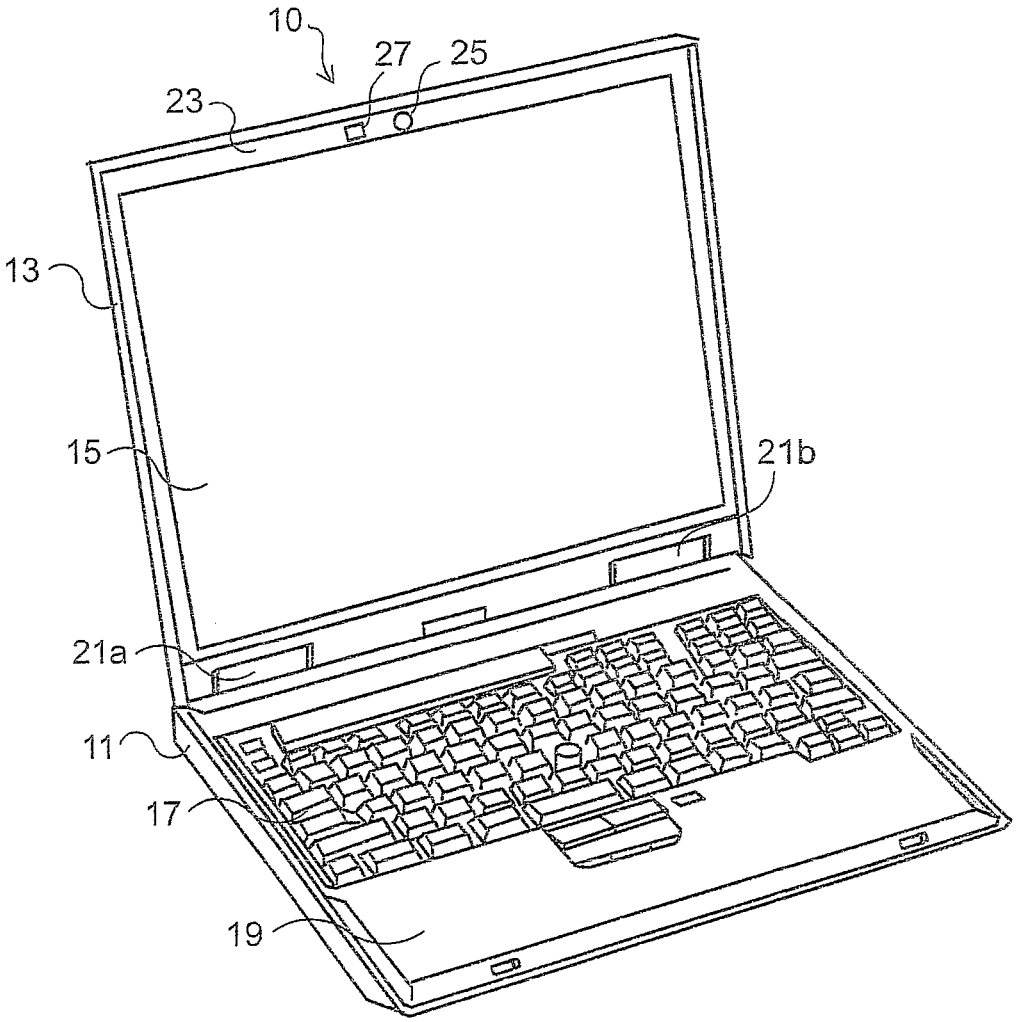
FIG. 1 is a perspective view of a laptop PC.

FIG. 1 is a perspective view of a laptop PC 10 according to a preferred embodiment of the present invention. The laptop PC 10 has an LCD module 15 housed in a display casing 13. A processor, a motherboard, a wireless module, a hard disk drive, and other system devices are housed in a system casing 11. A keyboard assembly 17 and a keyboard bezel 19 are attached to the upper surface of the system casing 11. The system casing 11 is made of a magnesium alloy. The system casing 11 and the display casing 13 are connected via hinges 21*a* and 21*b* in an openable and closable manner.

The display casing 13 is formed in a box shape to accommodate the LCD module 15 therein. A bezel 23 is attached to the display casing 13 to cover the gap formed between the side surface of the LCD module 15 and the inner surface of the sidewall of the display casing 13. Near the center of the bezel 23 on the upper side, an opening 25 for a camera and an opening 27 for a microphone are formed. The display casing 13 houses therein multiple antennas for use in wireless WAN, wireless LAN, WiMAX, and so on, and a circuit board on which a camera lens and a microphone are mounted. The circuit board is attached to the display casing 13 so that the positions of the camera lens and the microphone are aligned with the openings 25 and 27, respectively.

Figure 2:
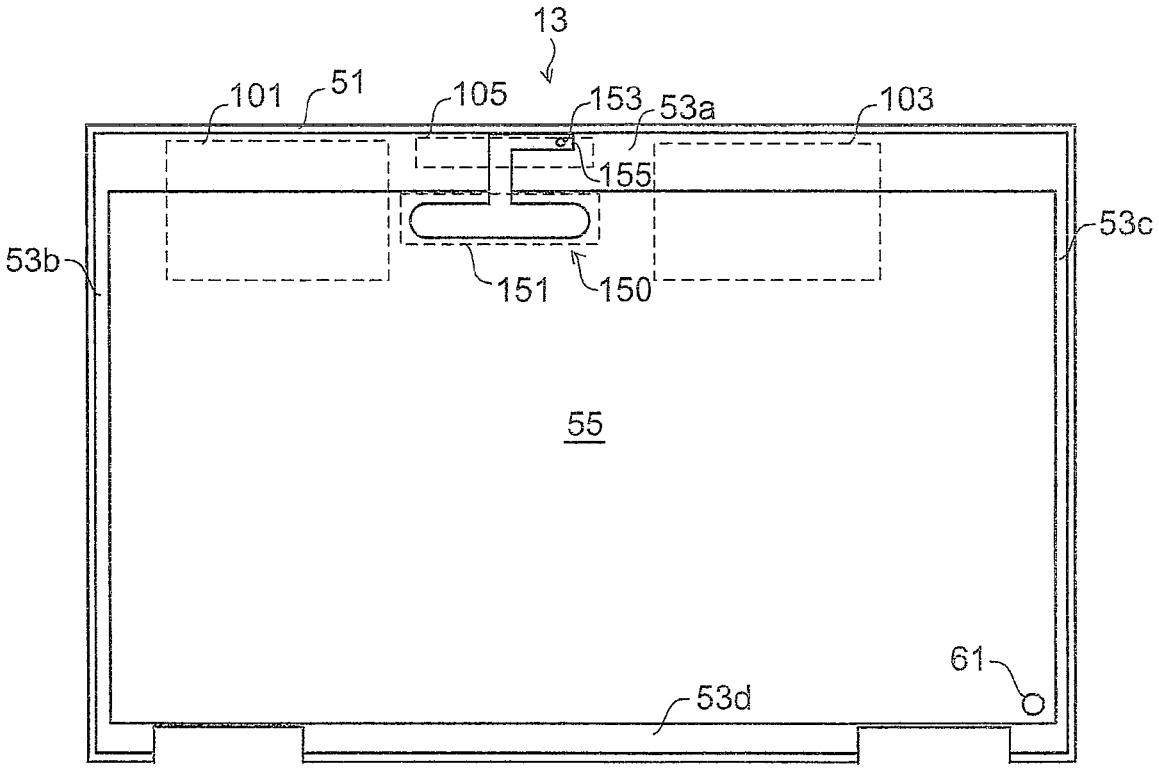
FIG. 2 shows a display casing of the laptop PC from FIG. 1 in the state where a bezel, an LCD module, and other devices have been removed therefrom.

FIG. 2 is a top view of the display casing 13 with the bezel 23, the LCD module 15, and other devices removed therefrom. The display casing 13 is formed as a box-shaped structure with its four sides surrounded by a sidewall 51. The bottom surface of the display casing 13 is made up of a central portion 55 and peripheral portions 53*a*, 53*b*, 53*c*, and 53*d* arranged around the central portion 55. The central portion 55 is made of a conductive material of carbon fiber reinforced plastic (CFRP), and the peripheral portions 53*a*, 53*b*, 53*c*, and 53*d* are made of a non-conductive material of glass fiber reinforced plastic (GFRP) or ABS resin. The sidewall 51 is made of the same material as the peripheral portions 53*a*, 53*b*, 53*c*, and 53*d*. The display casing 13 may be formed by injection molding by setting a shaped CFRP panel in a mold and injecting heated and melted GFRP into the mold.

The central portion 55 occupies the most part of the bottom surface. The central portion 55 works together with the system casing 11 to function as a shield for preventing electromagnetic interference (EMI) due to the electromagnetic waves that the devices housed in the laptop PC 10 emit to the outside and the electromagnetic waves that come in from the outside. The central portion 55 is provided with a tapping boss 61. The central portion 55 is electrically connected, via electric wire and/or metal connected to the tapping boss 61, to a ground plane of the motherboard and the system casing 11 that gives a reference potential to a signal line. On the bottom surface of the display casing 13, an ESD conductor 150 extends from the peripheral portion 53*a* onto the central portion 55. The ESD conductor 150 is formed of a thin metal sheet of aluminum, copper, or the like.

That part of the ESD conductor 150 which is included in a region 151 (see FIG. 2) is physically and electrically coupled to the central portion 55 via a conductive double-faced adhesive tape or a conductive adhesion bond. The rest part of the ESD conductor 150 is physically coupled to the peripheral portion 53*a* via a double-faced adhesive tape or an adhesion bond. The ESD conductor 150 includes a region that extends from the central portion 55 perpendicularly toward the sidewall 51, and a region that extends to an open end 155 in parallel with the sidewall. The ESD conductor 150 functions as a passive inverted-L antenna in which the part included in the region 151 and connected to the central portion 55 serves as a ground. The ESD conductor 150 has an opening 153 formed near its open end 155. The peripheral portion 53*a* has a tapping boss formed at a position beneath the opening 153, for attachment of a circuit board 300 shown in FIG. 5.

In FIG. 2, regions 101, 103, and 105 are defined in the peripheral portion 53*a* and the central portion 55. In the region 101, a wireless WAN main antenna 200 (FIGS. 3 and 4) is arranged. In the region 103, a wireless WAN auxiliary antenna 250 (FIG. 4) is arranged. In the region 105, the circuit board 300 mounted with a camera and a microphone (FIG. 5) is arranged. Although not illustrated, the peripheral portion 53*a* also includes regions where other antennas for WiMAX, wireless LAN, and so on are arranged. The regions 101 and 103 are arranged to sandwich the ESD conductor 150 therebetween. Each of the regions 101 and 103 includes a part of the peripheral portion 53*a* and a part of the central portion 55.

Figure 3:
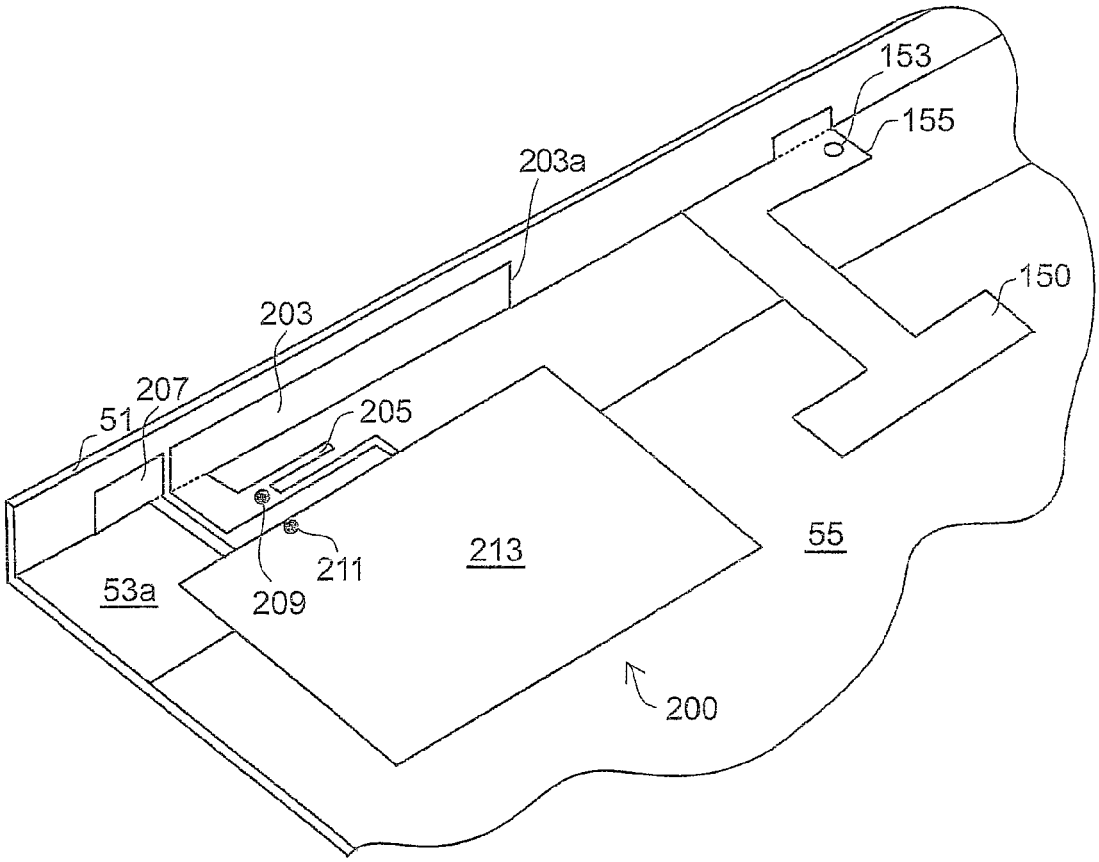
FIG. 3 is a perspective view of a main antenna and an ESD conductor within the laptop PC from FIG. 1.
Figure 4:
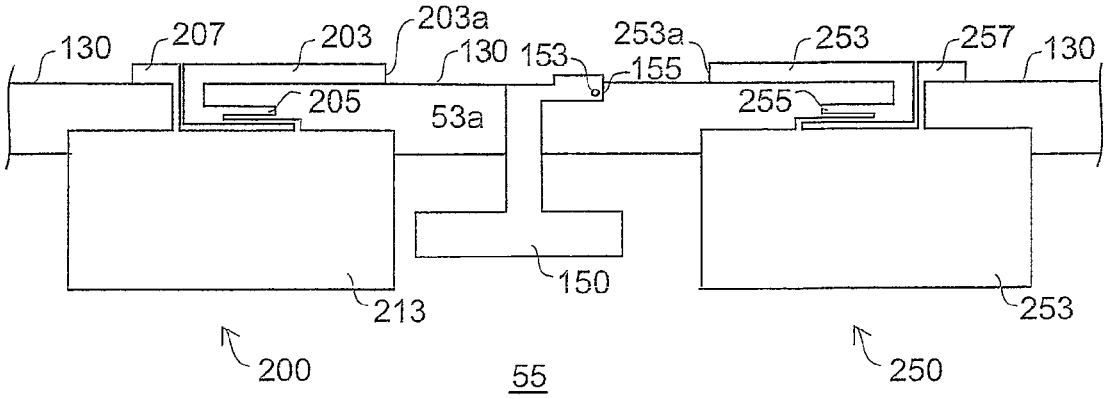
FIG. 4 is a top view of the main antenna, an auxiliary antenna, and the ESD conductor from FIG. 3.

FIG. 3 is a perspective view of the wireless WAN main antenna 200, which is arranged in the region 101, and the ESD conductor 150. FIG. 4 is a top view of the main antenna 200, the ESD conductor 150, and the auxiliary antenna 250, which are arranged in the display casing 13. The main antenna 200 is composed of a radiating element 203 that supports a lower frequency band from 700 MHz to 960 MHz, radiating elements 205 and 207 that support a higher frequency band from 1.7 GHz to 2.7 GHz, and a ground element 213.

The radiating elements 203 and 205 are driven elements constituting an inverted-F antenna that resonates at a quarter wavelength of the fundamental frequency. The radiating element 203 has an open end 203*a*. The radiating element 207 is a parasitic element constituting an inverted-L antenna that oscillates while exchanging electromagnetic energy with the radiating element 205. The radiating elements 203 and 205 are supplied with high-frequency power from coaxial cables connected to feeding positions 209 and 211. The coaxial cables are connected to the wireless module housed in the system casing 11.

The radiating elements 203, 205, and 207 are formed by punching and bending thin metal plates, and they are all arranged on the peripheral portion 53*a*. The radiating elements 203, 205, and 207 are attached to a plastic fixing frame. The main antenna 200 is attached to the display casing 13 by fixedly securing the fixing frame by screws. The fixing frame is not illustrated in FIG. 3, for better understanding of the antenna structure.

The ground element 213 is formed of a thin aluminum or copper sheet, which is connected, via a conductive adhesion bond or a conductive double-faced adhesive tape, to a metal plate (hidden under the ground element 213 in FIGS. 3 and 4) to which the radiating elements 203, 207, and 205 are connected. The main antenna 200 may be installed in a display casing entirely made of a non-conductive material. This means that the ground element 213 may or may not be electrically connected to the central portion 55.

The radiating element 205 has its flat surface disposed on the peripheral portion 53*a*. The radiating element 205 has its side extending approximately parallel to the sidewall 51. The ground element 213 is disposed on the peripheral portion 53*a* and the central portion 55. The radiating elements 203 and 207 have their flat surfaces bent at right angles in the intermediate positions, to be extended along the surface of the sidewall 51. The radiating elements 203 and 207 are bent at right angles in order to make the main antenna 200 fitted in the narrow space formed between the inner surface of the sidewall 51 and the LCD module 15. Alternatively, all the radiating elements 203, 205, and 207 may be disposed on the peripheral portion 53*a*.

The auxiliary antenna 250 is formed in the same shape as the main antenna 200. In FIG. 4, the auxiliary antenna 250 is arranged so as to be line symmetrical with the main antenna 200. The auxiliary antenna 250 is also connected to the wireless module, via coaxial cables different from those connecting the main antenna 200 to the wireless module. A description of the configuration of the auxiliary antenna 250 will not be provided, because it can be understood by referring to the configuration of the main antenna 200. The auxiliary antenna 250 may be configured to resonate at the same frequency band as the main antenna 200, so as to be used for communication using diversity or Multiple Input Multiple Output (MIMO).

In FIG. 4, the radiating elements 207, 203, 257, and 253 are illustrated to be on a same plane with the radiating elements 205 and 255 at a boundary 130 between the peripheral portion 53*a* and the sidewall 51 of the display casing 13. The ESD conductor 150 is arranged, near the open end 203*a* of the radiating element 203 of the main antenna 200 and near an open end 253*a* of the radiating element 253 of the auxiliary antenna 250, at a position where the ESD conductor 150 can exchange electromagnetic energy with both of the radiating elements 203 and 253. At the open ends 203*a* and 253*a*, the voltages of the standing waves that occur in the radiating elements 203 and 253 become maximum.

Figure 5:
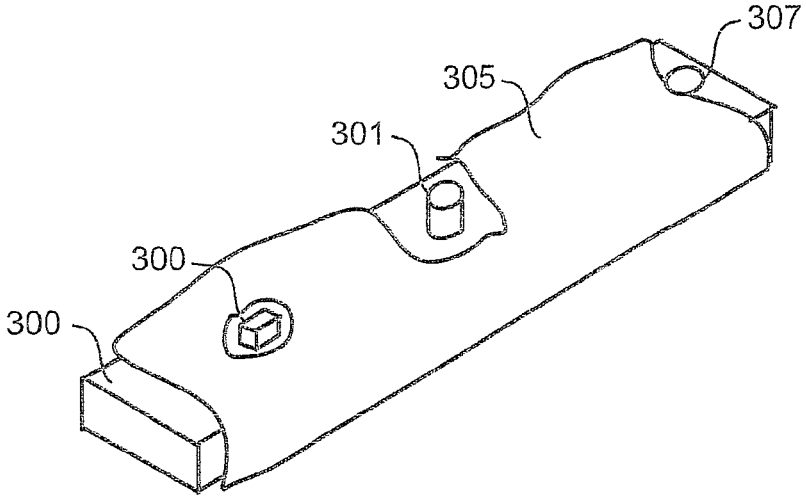
FIG. 5 is a perspective view of a circuit board on which a camera and a microphone are mounted.

FIG. 5 is a perspective view of the circuit board 300 that is arranged in the region 105. On the circuit board 300, a camera 301, a microphone 303, and a semiconductor chip related to their operations are mounted, and a circuit pattern connecting them is formed. The circuit board 300 is connected to a chip set on the motherboard via a shield of a signal line. The surface of the circuit board 300 is covered with an aluminum sheet 305 that exposes the camera 301 and the microphone 303. The aluminum sheet 305 extends to the back side of the circuit board 300. The aluminum sheet 305 functions as an arrester element that protects the elements mounted on the circuit board 300 from the surge voltage that is developed by the charges that come in through the openings 25 and 27 due to the aerial discharge of static electricity.

The circuit board 300 has an opening 307 for use in fixedly securing the circuit board 300 to the display casing 13. The circuit board 300 is coupled to the tapping boss by a screw that penetrates through the opening 307 and the opening 153 at the ESD conductor 150 so that the camera 301 and the microphone 303 are aligned with the openings 25 and 27, respectively, formed in the bezel 23. At this time, the aluminum sheet 305 is electrically coupled to the ESD conductor 150. While the aluminum sheet 305 is also connected to the ground plane of the motherboard via a shielded line, almost all the static charges are discharged to the central portion 55. As the ESD conductor 150 is able to connect the aluminum sheet to the large-sized central portion 55 with small impedance, it is possible to more effectively suppress the surge voltage in comparison with the conventional case where the sheet was connected to the ground plane of the motherboard only via the shield of the signal line.

The ESD conductor 150 functions as an ESD countermeasure enhancement part for the circuit board 300, and also functions as a gain improvement part for the main antenna 200 and the auxiliary antenna 250. In the case where the main antenna 200 and the auxiliary antenna 250 are identical in carrier frequency or in resonance frequency to each other, the ESD conductor 150 functions as a sub-resonant antenna that exchanges electromagnetic energy with the main antenna 200 or the auxiliary antenna 250 to thereby improve their gain around 700 MHz.

At the time of transmission, the ESD conductor 150 resonates with the electromagnetic energy received from either the main antenna 200 or the auxiliary antenna 250 and emits radio waves. At the time of reception, the ESD conductor 150 resonates with the electromagnetic energy received from the radio waves propagated in the air and supplies the electromagnetic energy to either the main antenna 200 or the auxiliary antenna 250. When the auxiliary antenna 250 is used for diversity, the wireless module selects one of the main antenna 200 and the auxiliary antenna 250 that is better in signal quality. The ESD conductor 150 has its length from the boundary between the central portion 55 and the peripheral portion 53*a* to the open end 155 adjusted such that, when the main antenna 200 or the auxiliary antenna 250 resonates at the frequency band around 700 MHz, the ESD conductor 150 resonates at a harmonic thereof.

While the above-described length of the ESD conductor 150 is adjusted such that the ESD conductor 150 resonates at a frequency that is eight times of 750 MHz in the present embodiment, the ESD conductor 150 may be configured to resonate at a harmonic of another order. The open end 155 of the ESD conductor 150 faces the auxiliary antenna 250. The geometrical states of electromagnetic coupling of the ESD conductor 150 with the main antenna 200 and the auxiliary antenna 250 differ from each other. Therefore, the distances from the open end 155 to the respective antennas for optimal electromagnetic coupling are different from each other. The appropriate distances can be set through experiments.

Figure 6:
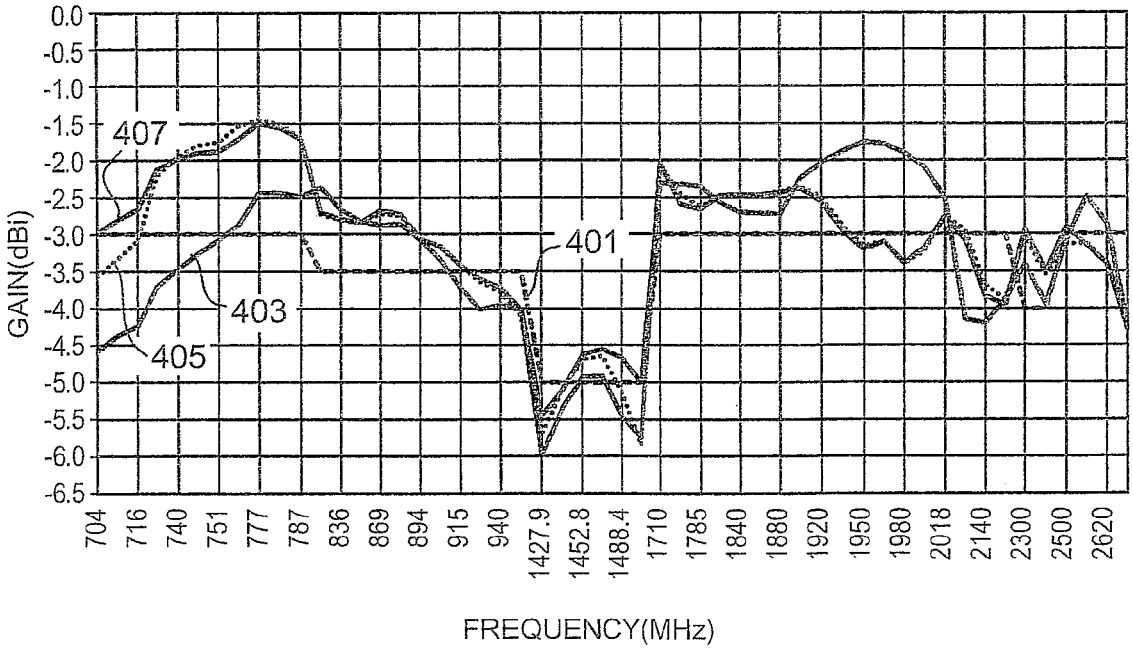
FIG. 6 shows the gain of the main antenna from FIG. 3.

FIG. 6 shows measurement results of the antenna gain (dBi) of the main antenna 200 from 700 MHz to 2.7 GHz. A line 401 indicates a reference value required for each frequency. A line 403 shows actual measurement values when there is no ESD conductor 150. The line 403 shows that the gain is less than the reference values in the frequency band lower than about 750 MHz. A line 405 corresponds to the state where the ESD conductor 150 is not connected to the central portion 55, with the part of the ESD conductor 150 within the region 151 in FIG. 2 removed. At this time, as the ESD conductor 150 functions as a non-grounded, passive inverted-L antenna, the line 405 indicate better results than in the line 403. However, the gain is still less than the reference values in the frequency band lower than about 716 MHz.

A line 407 corresponds to the state where the ESD conductor 150 is electrically connected to the central portion 55, as shown in FIG. 3. At this time, the ESD conductor 150 functions as a grounded, passive inverted-L antenna, and the main antenna 200 satisfies the reference values of the gain in the frequency bands of about 700 MHz and higher. Conventionally, the antenna was arranged as far apart as possible from the conductive material used for a countermeasure against ESD. In the present invention, in contrast, the ESD conductor 150 is arranged at a position where it is electrostatically or electromagnetically coupled to the antenna, so as to improve the gain. As the ESD conductor 150 can improve the gain in the lower frequency band, the element length of each of the main antenna 200 and the auxiliary antenna 250 for obtaining a certain gain can further be shortened, so that the space for the antennas can be reduced.

This means that when the antennas are arranged in a predetermined small space, the gain can be improved compared to the conventional case. The shape of the ESD conductor 150 is not limited to the inverted-L type; it may be a T or rod antenna. The present invention is applicable to wireless terminal devices and mobile electronic apparatuses including tablet terminals and smart phones.

As has been described, the present disclosure provides an antenna system adapted to a relatively low frequency band of wireless WAN.

While the disclosure has been particularly shown and described with reference to a preferred embodiment, it will be understood by those skilled in the art that various changes in form and detail may be made therein without departing from the spirit and scope of the disclosure.

What is claimed is:

1. A mobile device comprising:

a casing having a conductive region and a non-conductive region;

an antenna including a plurality of driven elements located in said non-conductive region;

a camera located on said conductive region; and an electrostatic discharge (ESD) conductor, located in said conductive region, connected to ground in order to protect said camera in said conductive region from electrostatic discharges, wherein said ESD conductor is disposed in proximity to said plurality of driven elements in order to function as a passive antenna to provide gain improvement to said antenna by exchanging electromagnetic energy with said plurality of driven elements.

2. The mobile device of claim 1, wherein said conductive region is arranged at a central portion of said casing, and said non-conductive region is arranged around said central portion of said casing.

3. The mobile device of claim 1, wherein said conductive region is made of carbon fiber reinforced plastic (CFRP).

4. The mobile device of claim 1, wherein said conductive region functions as electromagnetic shielding for said mobile device.

5. The mobile device of claim 1, further comprising:

an electronic device located in said non-conductive region; and an arrester element connected to said ESD conductor for protecting said electronic device from electrostatic discharges.

6. The mobile device of claim 5, wherein said electronic device is a microphone.

7. The mobile device of claim 1, wherein said antenna resonates at a frequency band from 700 Mhz to 960 MHz, and said ESD conductor resonates at a harmonic of a frequency at which said antenna resonates.

8. The mobile device of claim 1 further comprising:

an auxiliary antenna haying a plurality of driven elements, wherein said auxiliary antenna is located in said non-conductive region, wherein said auxiliary antenna is substantially identical to said antenna.

9. The mobile device of claim 8, wherein said antenna and said auxiliary antenna are inverted-F antennae.

* * * * *